US006520771B1

(12) United States Patent
Berry

(10) Patent No.: US 6,520,771 B1
(45) Date of Patent: Feb. 18, 2003

(54) BUG SHUTTER

(75) Inventor: Gary E. Berry, LaFollett, TN (US)

(73) Assignee: Lincoln Brass Works, Inc., Hendersonville, TN (US)

( * ) Notice: Subject to any disclaimer, the term of this patent is extended or adjusted under 35 U.S.C. 154(b) by 0 days.

(21) Appl. No.: 09/712,894

(22) Filed: Nov. 15, 2000

(51) Int. Cl.[7] ..... F23D 14/62

(52) U.S. Cl. ..... 431/354; 126/41 R; 239/407; 239/428.5

(58) Field of Search ..... 431/354, 355; 126/25 R, 41 R; 239/407, 428.5; 251/208

(56) References Cited

U.S. PATENT DOCUMENTS 556,628 A * 3/1896 Hallas ..... 431/355
3,905,756 A 9/1975 Ferlin et al.
4,747,391 A 5/1988 Hanagan et al.
4,817,583 A * 4/1989 Hanagan et al. ..... 126/41 R
4,829,978 A 5/1989 Schlosser
5,127,824 A 7/1992 Barker
5,163,830 A 11/1992 Pfefferkorn
D407,811 S 4/1999 Walters

* cited by examiner

*Primary Examiner*—Sara Clarke
(74) *Attorney, Agent, or Firm*—Waddey & Patterson; Larry W. Brantley

(57) ABSTRACT

A device for rotatably mounting on a mixing tube of a gas burner apparatus. The device includes a perforated shield portion for positioning over an air opening in the mixing tube to prevent insect intrusion therein, and an unperforated portion which partially or completely encloses an air opening of the mixing tube to prevent or limit primary air into said tube. A stop is provided on the device to limit rotation thereof and an extending tab provides for ease of rotation of the device on the mixing tube by providing an accessible surface against which pressure may be applied.

4 Claims, 2 Drawing Sheets

BUG SHUTTER

TECHNICAL FIELD

The present invention relates to a combined air shutter and insect guard for use in a gas appliance. The device is rotatably mounted around the mixing tube of a gas burner and controls the air intake of the mixing tube and also serves as an insect guard to prevent insects from entering and clogging the mixing tube.

BACKGROUND OF THE INVENTION

The use of outdoor gas appliances such as gas grills and gas barbecues has become prevalent today. However, because of the use of these appliances and their storage in an outdoor location, the appliances are subject to the elements, which includes allowing insect life access to their internal components.

For instance, insects such as spiders, wasps, bees, grasshoppers, and arachnids have been known to enter the mixing tubes and other fuel feed lines of gas burners and clog theses lines thus interrupting fuel flow to the burners which may cause improper operation or malfunctioning of the unit. In addition, insects which enter the mixing tube may die inside the tube and their bodies may disrupt or constrict the flow of gas to the burner which is undesirable for proper operation of these grills.

Past gas grill manufacturers have attempted to remedy this problem by recommending periodic cleaning of the mixing tube and providing tools to perform this task. In addition manufacturers of gas grills have cautioned users about this type of problem and recommended periodic inspections of the mixing tube and primary air opening.

Additionally, the problem of insect intrusion into the mixing tube has been addressed in U.S. Pat. No. 4,747,391, entitled "Insect Guard For A Gas Appliance". The guard includes a cylindrical member which slideably fits over the end of the mixing tube. The member is configured in the shape of a thimble and is made of screen material. The screen member extends circumfuentially around the mixing tube to encompass air openings on the outer periphery of the Venturi tube. The device serves only as an insect guard.

In a separate embodiment of the device disclosed in U.S. Pat. No. 4,747,391 a separate air shutter is disclosed. The air shutter controls (adjusts) the fuel to air mixture which reaches the burner. The air shutter can be rotated around the mixing tube to adjust the size of the primary air opening. A separate insect guard which is a screen is inserted into the mixing tube at the primary opening to restrict the air opening from entrance by an insect.

A U.S. Pat. No. 3,905,756 issued to William J. Ferlin, et al., on Sep. 16, 1975, is entitled "Shutter Structure And Mixing Tube Assembly For Gas Burners" The device controls the mixture of fuel gas and air that is furnished to a gas burner. In this patent a C-shaped band of metal is frictionally engaged around a portion of the mixing tube having a pair of opposed primary air inlets. The band of metal has one opening in the body portion thereof which is disposed for registry with one of the primary air inlets openings. A second opening is defined by the spacing between distal ends of the c-shaped member and is disposed registry with a primary air opening. This device does not provide means for preventing insect intrusion when a side primary opening of the mixing tube is open to the atmosphere.

SUMMARY OF THE INVENTION

In accordance to the present invention, there is provided a combined air shutter and insect guard for use in a gas appliance provided with a mixing tube having at least one primary air inlet therein. The insect guard portion of the combined air shutter and insect guard prevents clogging of the mixing tube by insects which may attempt to enter the primary air opening even while primary air is being admitted into the tube. Integral with and forming a portion of the combined air shutter and insect guard is a shutter portion which partially or completely blocks a primary inlet and thus controls the fuel to air mixture which reaches the burner.

It is, therefore, an object of the present invention to provide a combined insect guard and shutter device which guards against intrusion of insects into a primary air entrance of a mixing tube and which adjusts the fuel to air mixture in the mixing tube.

DESCRIPTION OF THE INVENTION

A combined insect guard and air shutter device which prevents insects from entering the mixing tube of a gas burner apparatus and a shutter which adjusts the primary air intake of the mixing tube to control airflow therein is generally shown at 10. The device is hereinafter referred to as a "bug shutter".

Figure 1:
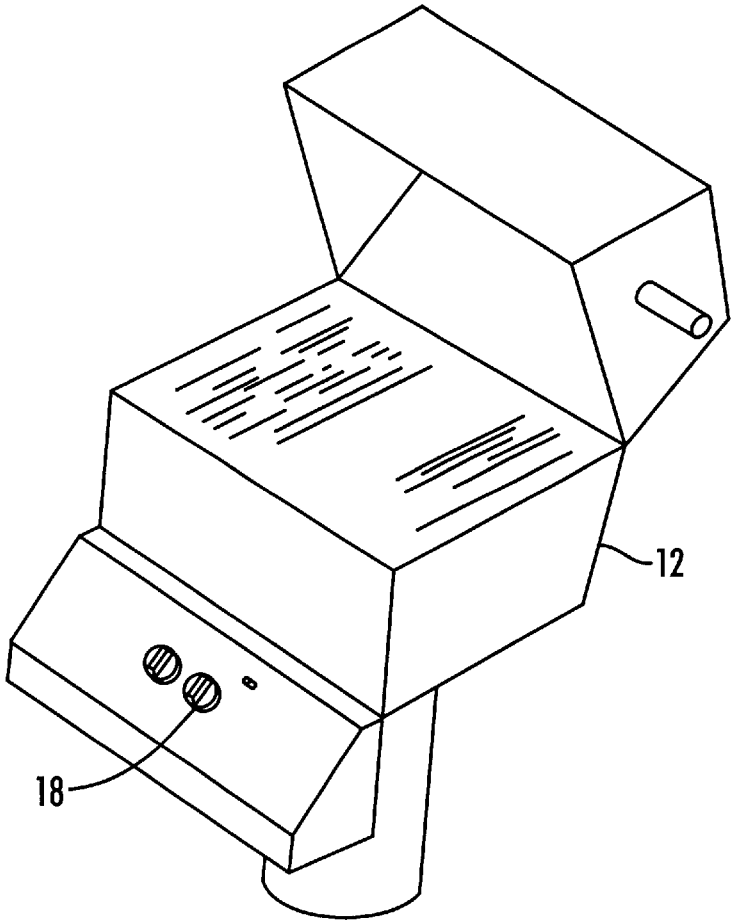
FIG. 1 is a perspective view of a gas grill utilizing the present invention.
Figure 2:
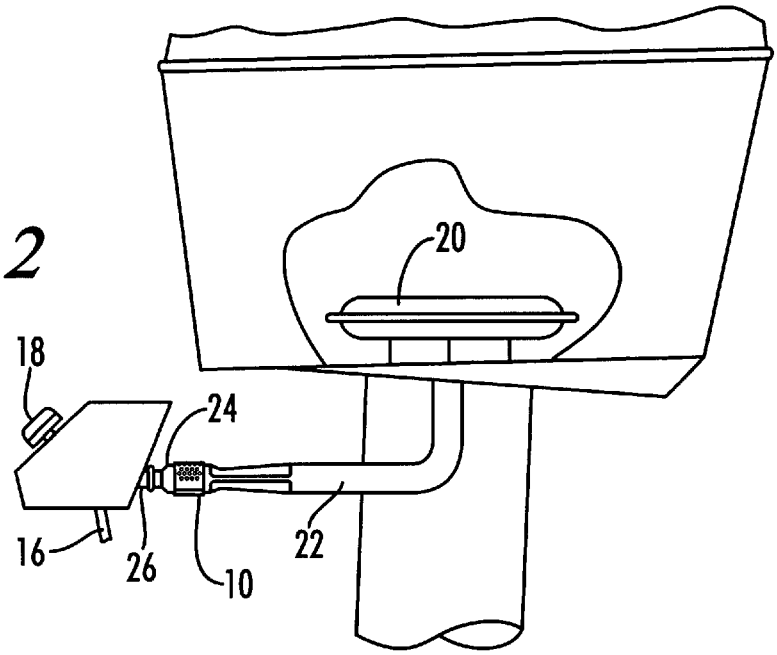
FIG. 2 is a elevational side view of the device of the present invention as used in a gas burner apparatus.

In general, as shown in FIGS. 1 and 2, gas grills produced today include a gas grill body portion 12 which has a fuel supply and a supply line 16 which leads to control valves 18 which are for controlling the gas allowed to pass to the burners 20.

The connection between the control valve 18 and the burner 20 is a mixing tube 22. The mixing tube 22 has an open end 24 which connects to an orifice outlet 26 from the control valve 18. Adjacent the open end 24 of mixing tube 22 at least one primary air opening is provided in tube 22 and allows for the fuel to mix with air or oxygen to provide a combustible fuel to be ignited at the burner 20. However, in general, the mixing tube 22 is provided with a pair of diametrically opposed primary air openings which are designated herein by the numerals 28 and 29 in FIGS. 4 and 5.

In general, gas grills are provided with wheels or they may be permanently mounted to a fixture in an outdoor location such as the backyard of a homeowner. Due to the outdoor use and storage of gas grills, in garages and backyards, insects have been found to enter mixing tube 22 through primary air openings 28 and 29 and thereby crawl into the tube and spin webs or nests or otherwise clog mixing tube 22. These instances by insects may constrict or block the flow of combustible mixture from the supply line 16 through mixing tube 22 to burner 20. This may cause in operation of the burner or may cause a flashback problem at the primary air openings 28 and 29 due to fuel which is escaping through the primary air opening 28 because of constriction of mixing tube 22.

The device 10 of the present invention protects the primary opening (or openings) in a gas burner apparatus 12 against insect intrusion even while allowing outside (primary) air into a non-covered primary air opening.

In addition, the device of the present invention includes means to allow for adjusting the primary air flow through air flow openings 28 and 29 by either completely or partially closing off at least one of the side openings.

Figure 6:
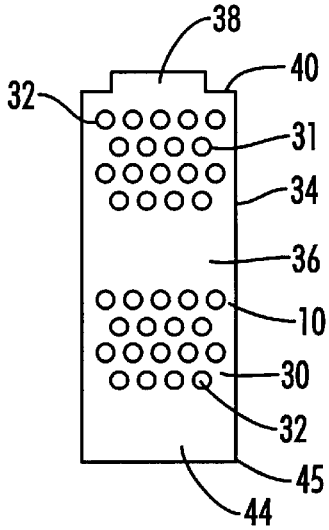
FIG. 6 is a layout of the bug shutter prior to the material being rolled into a substantially C-shaped configuration as seen in FIGS. 3, 4 and 5.

The bug shutter is shown in FIG. 6 to include two spaced sets 30 and 31 of spaced openings 32 in a resiliently flexible, rigid, member or body 34. A solid, unperforated guard portion 36 is disposed between and separates the sets of openings 30 and 31. A tab 38 is provided on one end 40 of the body 34 of bug shutter 10 and a second end 44 is disposed for bending inwardly to form a shoulder 46 for reasons described herein below. It is to be understood that various size small openings in the bug shutter body may be resorted to. The small openings serve as an insect shield and prevent insects from entering tube 22.

Figure 3:
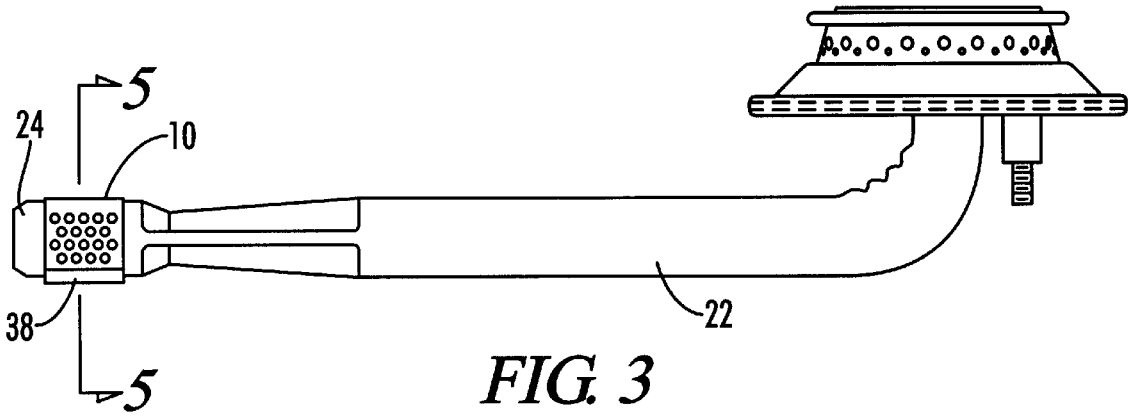
FIG. 3 is an elevational view of the mixing tube and burner.
Figure 4:
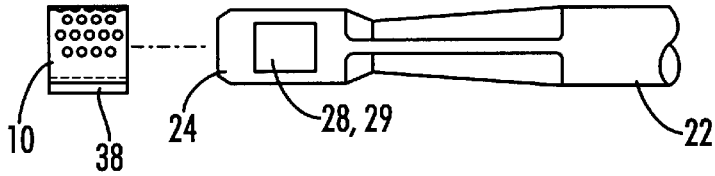
FIG. 4 is an exploded view illustrating the combined air shutter and insect guard prior to assembly thereof.
Figure 5:
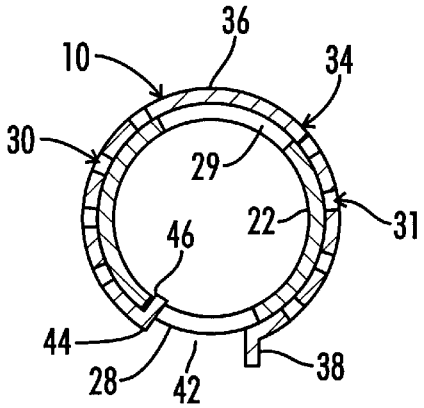
FIG. 5 is an enlarged sectional view taken along line 5—5 of FIG. 1.

FIG. 3 is an elevational view a gas burner and mixing tube and illustrates the bug shutter 10 of the present invention installed on the peripheral surface of mixing tube 22. In FIGS. 3, 4, and 5 the bug shutter 10, has been rolled into a substantially C-shaped configuration and frictionally engages the outer surface of tube 22.

FIG. 5 is a sectional view taken along line 5—5 of FIG. 3. As seen in FIG. 5, body 34 is frictionally engaged around tube 22 and is formed into a C-shaped configuration. The distal ends 38 and 44 of the "C" form a gap 42 which defines an opening for registry with primary air inlet 28. FIG. 5 shows a gap or opening 42 in registry with air inlet 28. End 44 of member 34 is shown to be bend inwardly to provide a shoulder 46 which extends inwardly into primary air inlet 28. The shoulder forms a stop to limit the amount of rotation of body 34 on tube 22 and is shown in FIG. 5 to be engaged with a peripheral surface of opening 28 which prevents further clockwise rotation of body 34. The shoulder 44 also assists in the assembly of the shutter structure to the mixing tube by engaging a side edge of the inlet opening within which the shoulder is inserted. This allows a tangential force to be exerted manually on tab 38 causing the shutter body to flex resiliently open for snap-over engagement with tube 22.

End 38 is shown in FIG. 5 to be bent outwardly to provide a tab which serves as a means by which the body 34 is rotated around tube 22.

As seen in FIG. 5 the solid, unperforated portion 36 of body 34 covers air inlet 29 and the sets of small openings 30 and 31 are not in registry with either primary air inlet 28 or 29. However, as can be ascertained from FIG. 5, by grasping tab 38 and rotating the tab 38 in a counterclockwise direction, the set of 30 openings 32 can be positioned over air inlet 28 and the set 31 of openings 32 can be positioned over primary air inlet 29. In this position both primary air inlets 28 and 29 are shielded from insect intrusion while simultaneously permitting air to enter tube 22 through both primary air inlets to mix with the gases therein.

Thus it is apparent that there has been provided in accordance with the invention a barbecue burner that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim:

1. A combined insect guard and air shutter device for a gas burner apparatus, the apparatus including a mixing tube for directing gas and air to the burner, and the mixing tube having first and second side openings defined therein, comprising:

a resiliently flexible substantially rigid C-shaped band having a first distal end and a second distal end angularly spaced apart and defining an opening;

a solid portion of the band generally opposite from the opening defined by the distal ends of the band;

a first perforated portion defined in a portion of the band between the solid portion and the first distal end;

a second perforated portion defined in a portion of the band between the solid portion and the second distal end;

wherein the band may be positioned on the mixing tube in a first position so that the solid portion completely blocks the first side opening defined in the mixing tube and the opening defined by the distal ends of the band is positioned over the second side opening defined in the mixing tube; and wherein the band may be positioned on the mixing tube in a second position so that each perforated portion is positioned over one of the side openings defined in the mixing tube.

2. The combined insect guard and air shutter device of claim 1, wherein the band includes stop means to limit rotation thereof about the mixing tube.

3. The combined insect guard and air shutter device of claim 2, wherein the stop means is defined by an inwardly extending shoulder provided on the first distal end of the flexible band, the shoulder disposed for engagement with the periphery of one of the side openings defined in the mixing tube.

4. The combined insect guard and air shutter device of claim 3, further including an outwardly extending tab disposed on the second distal end of the flexible band for providing an extended surface against which pressure may be applied for rotation of the flexible band on the mixing tube.

* * * * *